US008091701B1

(12) United States Patent
DePietro

(10) Patent No.: US 8,091,701 B1
(45) Date of Patent: Jan. 10, 2012

(54) MAGNETIC BRUSH PROTECTOR AND STORAGE APPARATUS

(76) Inventor: Claudio DePietro, Loganville, GA (US)

( * ) Notice: Subject to any disclaimer, the term of this patent is extended or adjusted under 35 U.S.C. 154(b) by 316 days.

(21) Appl. No.: 12/565,782

(22) Filed: Sep. 24, 2009

(51) Int. Cl.
*B65D 75/14* (2006.01)
*B65D 5/50* (2006.01)

(52) U.S. Cl. ..... 206/15.3; 206/818

(58) Field of Classification Search ..... 206/361, 206/362, 15.2, 15.3, 818, 784, 525.1
See application file for complete search history.

(56) References Cited

U.S. PATENT DOCUMENTS

| | | | | |
|---|---|---|---|---|
| 3,981,399 | A | 9/1976 | Crouch | |
| 4,363,433 | A * | 12/1982 | Jaques | 224/674 |
| 4,533,044 | A | 8/1985 | Ban | |
| 4,751,762 | A | 6/1988 | Meimeteas | |
| 5,244,090 | A | 9/1993 | Keith | |
| 5,465,453 | A | 11/1995 | Landmeier | |
| 5,540,363 | A | 7/1996 | Wilson | |
| 5,645,167 | A | 7/1997 | Conrad | |
| D393,545 | S | 4/1998 | Fernandes | |
| 5,791,608 | A | 8/1998 | Nielsen | |
| 5,797,489 | A | 8/1998 | Baker | |
| 6,050,408 | A | 4/2000 | Testa | |
| 6,199,694 | B1 | 3/2001 | Van Diest | |
| 6,338,406 | B1 | 1/2002 | Zagar | |
| 6,575,295 | B2 | 6/2003 | Mayfield | |
| 6,675,966 | B1 | 1/2004 | Ray | |
| 6,681,924 | B2 | 1/2004 | Renzello | |
| 6,757,931 | B2 | 7/2004 | Nordstrom | |
| 6,907,988 | B2 | 6/2005 | Jimenez | |
| 6,932,217 | B1 | 8/2005 | Bailey | |
| 7,007,797 | B1 * | 3/2006 | Ruccolo | 206/362.4 |
| 7,611,009 | B2 * | 11/2009 | Youngs | 206/81 |
| 7,918,620 | B2 * | 4/2011 | Del Ponte | 401/131 |
| 7,946,418 | B1 * | 5/2011 | Cerynik | 206/362 |

* cited by examiner

*Primary Examiner* — Jacob K Ackun
(74) *Attorney, Agent, or Firm* — Theodore Heske, III

(57) ABSTRACT

Disclosed are embodiments of an apparatus to store and protect paintbrushes. The apparatus comprises a first outer shell flexibly coupled to a second outer shell in an arrangement suitable for the storage of a paintbrush in the interior space described by first and second outer shells. A brush shaping flap, which is flexibly coupled to an outer shell, maintains the shape of brush bristles while a brush is stored in the apparatus. One or more magnetic elements are used to hold the brush in place in the apparatus. The magnetic elements are positioned to engage the ferromagnetic ferrule of a paintbrush. An attachment means may be coupled to the apparatus thus allowing for convenient attachment to a persons belt. A plurality of ventilation holes may be provided on the apparatus. A spring means may be provided for urging the bristle shaping flap against the brush bristles.

18 Claims, 10 Drawing Sheets

MAGNETIC BRUSH PROTECTOR AND STORAGE APPARATUS

CROSS REFERENCE TO RELATED APPLICATIONS

Not Applicable.

STATEMENT REGARDING FEDERALLY SPONSORED RESEARCH OR DEVELOPMENT

Not Applicable.

DESCRIPTION OF ATTACHED APPENDIX

Not Applicable.

BACKGROUND

The present disclosure relates to the field of paintbrushes and associated tools and accessories. A paintbrush in the hands of a skilled tradesman is capable of producing a very fine quality finish. The condition of a paintbrush, quality of a paintbrush, and the skill of the tradesman all contribute to the quality of the finish produced by the tradesman. A high quality finish, which increases the value of the tradesman's work, requires a brush that is in good condition. Also, a job may be most speedily completed using a high quality brush that is in good condition. Clearly, the value of the tradesman's work and the speed with which that work can be completed have a direct economic impact on the tradesman. In addition, a high quality brush may be expected to cost the tradesman more than a low quality brush. If the condition of the paintbrush is maintained then it will provide a longer working life. A longer working life for a paintbrush also has a direct economic impact on the tradesman. In consideration of the foregoing points it is clear that preserving the condition of a paintbrush confers a number of advantages and is therefor highly desirable.

Anyone engaged on a job with a paintbrush quickly discovers the need to put that paintbrush down in order to use one or both hands for another task. The typical options for putting a paintbrush down include: resting the paintbrush on the edge of a paint can, resting the paintbrush on a ladder, placing the paintbrush on a tarp or other surface. These and other typical options expose the paintbrush to the possibilities of: soiling the bristles of the paintbrush, unwanted transference of paint from the paintbrush bristles to other surfaces or objects, falling of the paintbrush from an elevated resting place resulting in unwanted transference of paint from the paintbrush bristles to other surfaces or objects, and even temporary inability to find the paintbrush again when it is needed. It is therefor highly desirable to have a safe and easily remembered place to put a paintbrush when it is not needed.

SUMMARY

The present disclosure is directed to apparatus for storing and protecting a paint brush. An embodiment of an apparatus according to this disclosure comprises: a first outer shell comprising: a back panel having a first side and a second side; a first lateral panel coupled to said first side of said back panel; a second lateral panel coupled to said first side of said back panel, wherein a portion of said first lateral panel and a portion of said second lateral panel are substantially parallel; a top panel coupled to said first side of said back panel and coupled to said first lateral panel and coupled to said second lateral panel, wherein said top panel has a recess portion, and wherein said top panel is substantially perpendicular to at least a portion of said first lateral panel; a first magnet means coupled to said back panel of said first outer shell wherein said first magnet means is substantially parallel to said top panel of said first outer shell; a bristle shaping flap having a proximal end and a distal end, wherein at least a portion of said bristle shaping flap is sized to movably fit between said first lateral panel and said second lateral panel; a first flexible coupling connecting said first outer shell to said proximal end of said bristle shaping flap, wherein said first flexible coupling allows movement of said bristle shaping flap with respect to said first outer shell to a closed position in which at least a portion of said bristle shaping flap is disposed between at least a portion of said first lateral panel and at least a portion of said second lateral panel, and, wherein said first flexible coupling allows movement of said bristle shaping flap with respect to said first outer shell to an open position in which no portion of said bristle shaping flap is disposed between said first lateral panel and said second lateral panel; a second outer shell having a first side, a second side, a proximal end, and a distal end; a second flexible coupling connecting said first lateral panel of said first outer shell to said proximal end of said second outer shell, wherein said second flexible coupling allows movement of said first outer shell with respect to said second outer shell to a closed position in which said second outer shell urges said bristle shaping flap to its closed position, and, wherein said second flexible coupling allows movement of said first outer shell with respect to said second outer shell to an open position in which said second outer shell is disposed to allow said bristle shaping flap to move between its open and closed positions; and, a fastener comprising a first portion and a second portion, wherein said first portion of said fastener is coupled to said first outer shell and wherein said second portion of said fastener is coupled to said distal end of said second outer shell, and wherein said first portion and said second portion of said fastener are disposed to fasten to each other when said second flexible coupling is in said closed position.

In a related embodiment, the apparatus may additionally comprise: a second magnet means coupled to said bristle shaping flap, wherein said second magnet means is located towards said distal end of said bristle shaping flap, and, wherein said second magnet means is positioned substantially parallel to said first magnet means when said bristle shaping flap is in said closed position.

In a related embodiment, the apparatus may additionally comprise: spring means coupled to the second outer shell, wherein said bristle shaping flap is urged to its closed position by said spring means when the second outer shell is in its closed position.

In a related embodiment of the apparatus at least one element from the group consisting of: first outer shell, second outer shell, and bristle shaping flap, has a plurality of ventilation holes.

In a related embodiment of the apparatus the bristle shaping flap has a first edge and a second edge, and the apparatus may further comprise: a first bristle retention skirt coupled to said bristle shaping flap and coextensive with at least a portion of said first edge of said bristle shaping flap, and a second bristle retention skirt coupled to said bristle shaping flap and coextensive with at least a portion of said second edge of said bristle shaping flap, wherein said first bristle retention skirt is sized to movably fit against said first lateral panel when said bristle shaping flap is in its closed position, and, wherein said second bristle retention skirt is sized to movably fit against said second lateral panel when said bristle shaping flap is in its closed position.

In a related embodiment, the apparatus may additionally comprise: an attachment means coupled to said second side of said back panel of said first outer shell, wherein said attachment means is positioned to align a portion of said first lateral panel substantially parallel with a portion of a leg of a person when the apparatus is attached to a belt worn by said person.

In a related embodiment a portion of the bristle shaping flap extends above said top panel of said first outer shell when said bristle shaping flap is in its closed position.

In a related embodiment of the apparatus the first magnet means is an elongate planar magnetic strip.

In a related embodiment of the apparatus the second magnet means is an elongate planar magnetic strip.

The present disclosure is also directed to a system for storing and protecting a paintbrush wherein the system comprises a paintbrush and an apparatus for storing and protecting the paintbrush. The paintbrush comprises a handle, a ferromagnetic ferrule, and bristles. The apparatus for storing and protecting the paintbrush is an apparatus constructed according to the teachings of the present disclosure.

BRIEF DESCRIPTION OF THE DRAWINGS

These and other features, aspects, and advantages of the present invention will become better understood with regard to the following description, appended claims, and accompanying drawings where:

LIST OF REFERENCE NUMBERS APPEARING IN THE FIGURES

2—Magnetic brush protector and storage apparatus.
10—Paintbrush.
12—Paintbrush handle.
14—Paintbrush ferrule.
16—Paintbrush bristles.
20—First outer shell.
22—Back panel.
22*s*1—Back panel first side.
22*s*2—Back panel second side.
24—First lateral panel.
26—Second lateral panel.
28—Top panel.
29—Top panel recess portion.
30—First flexible coupling. (Hinge)
32—Second flexible coupling. (Hinge)
40—First magnet means.
42—Second magnet means.
50—Second outer shell.
50*s*1—Second outer shell first side.
50*s*2—Second outer shell second side.
50*p*—Second outer shell proximal end.
50*d*—Second outer shell distal end.
58—Spring means.
60*a*—First fastener portion.
60*b*—Second fastener portion.
70—Bristle shaping flap.
70*p*—Bristle shaping flap proximal end.
70*d*—Bristle shaping flap distal end.
70*e*1—Bristle shaping flap first edge.
70*e*2—Bristle shaping flap second edge.
78*a*—First bristle retention skirt.
78*b*—Second bristle retention skirt.
80, 80*a*, 80*b*—Ventilation holes.
82—Attachment means.

DESCRIPTION

Embodiments of the present disclosure provide apparatus for safely and securely storing a paintbrush, preserving the bristles of a paintbrush, and doing so in a way that is convenient to the user of the paintbrush.

Figure 1:
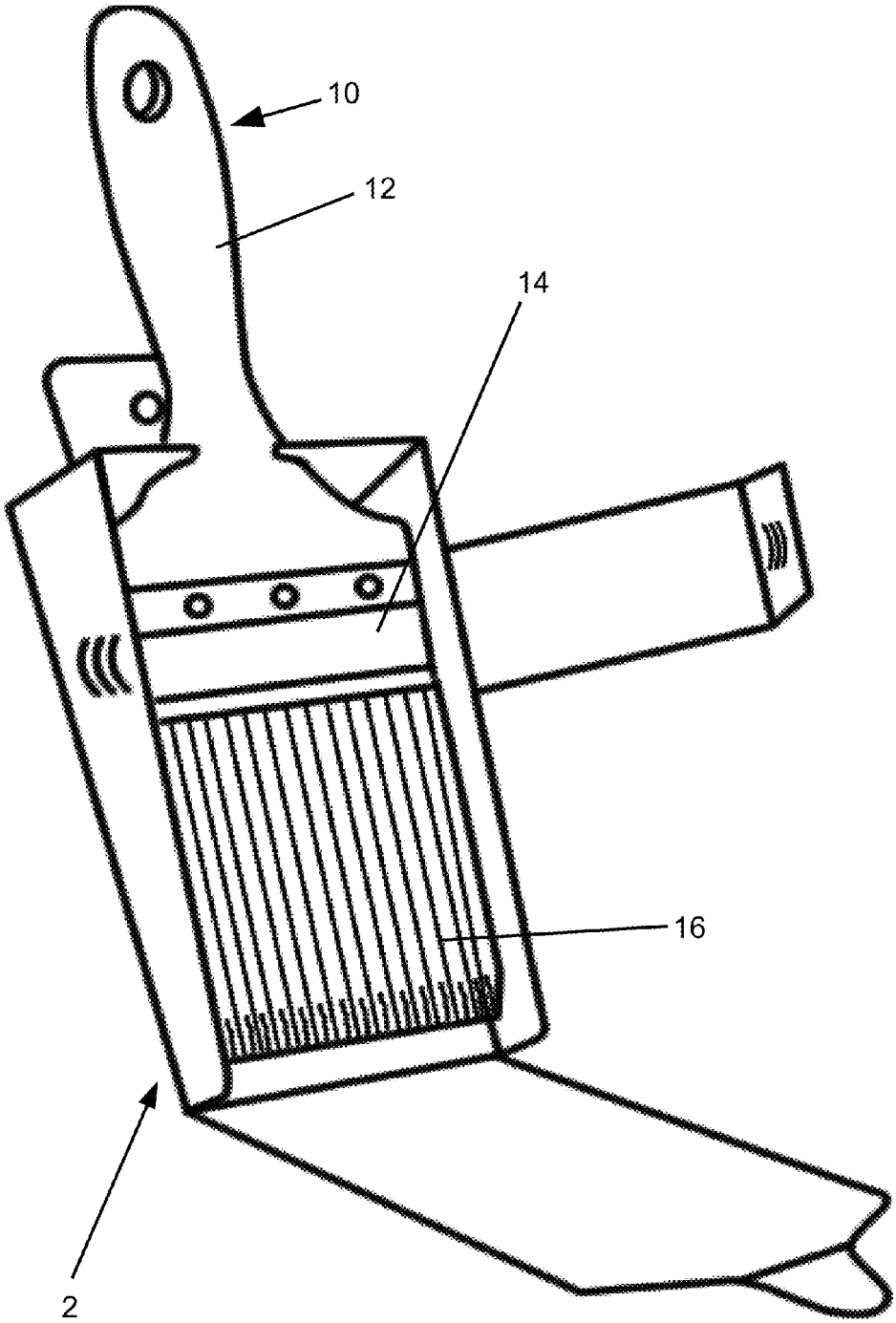
FIG. 1 shows a perspective view of an exemplary paintbrush fitted into an apparatus according to an embodiment of the present disclosure.

Turning now to FIG. 1, an embodiment of magnetic brush protector and storage apparatus 2 according to the present disclosure is shown with a paintbrush received into the apparatus. Paintbrush 10 is shown in FIG. 1 comprising handle 12, ferrule 14, and bristles 16. Embodiments of the present disclosure take advantage of the common use of ferromagnetic materials in ferrule 14 by using one or more magnetic elements to exert an attractive force on a paintbrush ferrule in magnetic brush protector and storage apparatus 2.

Figure 2:
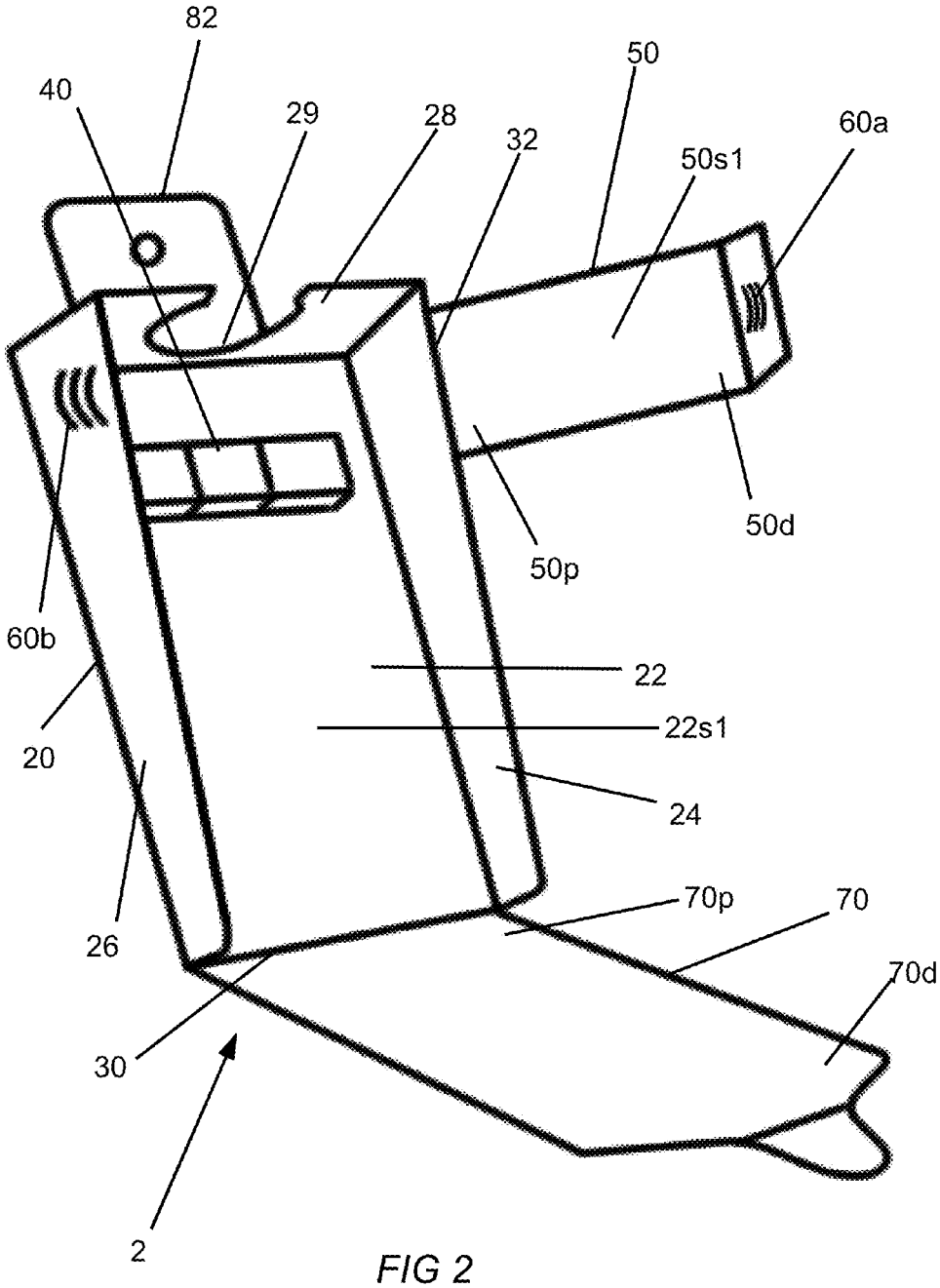
FIG. 2 shows a perspective view of a preferred embodiment of an apparatus according to the present disclosure.

Turning now to FIG. 2, an embodiment of magnetic brush protector and storage apparatus 2 is shown. The embodiment of FIG. 2 is shown comprising: a first outer shell 20, a second outer shell 50, a bristle shaping flap 70, a first flexible coupling 30, a second flexible coupling 32, a first magnet means 40, and a fastener comprising a first portion 60*a*, and a second portion 60*b*. First outer shell 20, second outer shell 50, and bristle shaping flap 70 may be constructed of rigid or semi rigid materials, wherein preferable materials are resistant to paints and the solvents typically found in paints. In a preferred embodiment, first flexible coupling 30 and second flexible coupling 32 may be constructed of the same materials as first outer shell 20, second outer shell 50, and bristle shaping flap 70.

First outer shell 20 is shown comprising: a back panel 22 having a first side 22*s*1, a first lateral panel 24, a second lateral panel 26, and a top panel 28. Top panel 28 is shown as having a recess portion 29 wherein said recess portion is suitable to removably receive paintbrush handle 12. Back panel 22, first lateral panel 24, second lateral panel 26, and top panel 28 are shown as a generally planar members, each having a predetermined thickness. First outer shell 20 is shown as being created by coupling back panel 22 to first lateral panel 24, to second lateral panel 26, and to top panel 28. First outer shell 20 is constructed to create a recess suitable for the placement within it of a portion of paintbrush handle 12, the entirety of paintbrush ferrule 14, and the entirety of paintbrush bristles 16. First magnet means 40 is coupled to first outer shell and positioned so that the attractive force exerted by first magnet means 40 upon ferrule 14 urges the paintbrush to reside within the recess between first lateral panel 24 and second lateral panel 26. In a preferred embodiment of the apparatus 2, at least a portion of first lateral panel 24 is parallel to at least a portion of second lateral panel 26. Top panel 28 has a recess portion 29 positioned to removably receive the paintbrush handle 12 when paintbrush 10 is residing within the first outer shell. Top panel 28 and recess portion 29 are positioned with respect to back panel 22, first lateral panel 24, and second lateral panel 26 so that when a brush is residing within the apparatus 2 a portion of handle 12 extends beyond the confines of the apparatus and extends in a manner that is substantially parallel to at least a portion of first lateral panel 24 or second lateral panel 26 or both first and second lateral panels. First outer shell 20 may be constructed of rigid or preferably semi rigid materials, wherein preferable materials are resistant to paints and the solvents typically found in paints. Rigidity and durability of first outer shell 20 may be enhanced by coupling top panel 28 to one or both of first lateral panel 24 and second lateral panel 26.

A preferred embodiment of first magnet means 40 is an elongate planar magnetic strip coupled to back panel 22 such that the long axis of the elongate magnetic strip is disposed to be substantially parallel to top panel 28 and wherein first magnet means 40 is positioned to engage at least a portion of ferrule 14 when brush 10 resides within first outer shell 20. When brush ferrule 14 is engaged by the force exerted by first magnet means 40 the brush may be held securely and is substantially prevented from sliding around within first outer shell. The prevention of sliding of the paintbrush within the first outer shell 20 further contributes to the protection and preservation of the paintbrush bristles 16.

Figure 4:
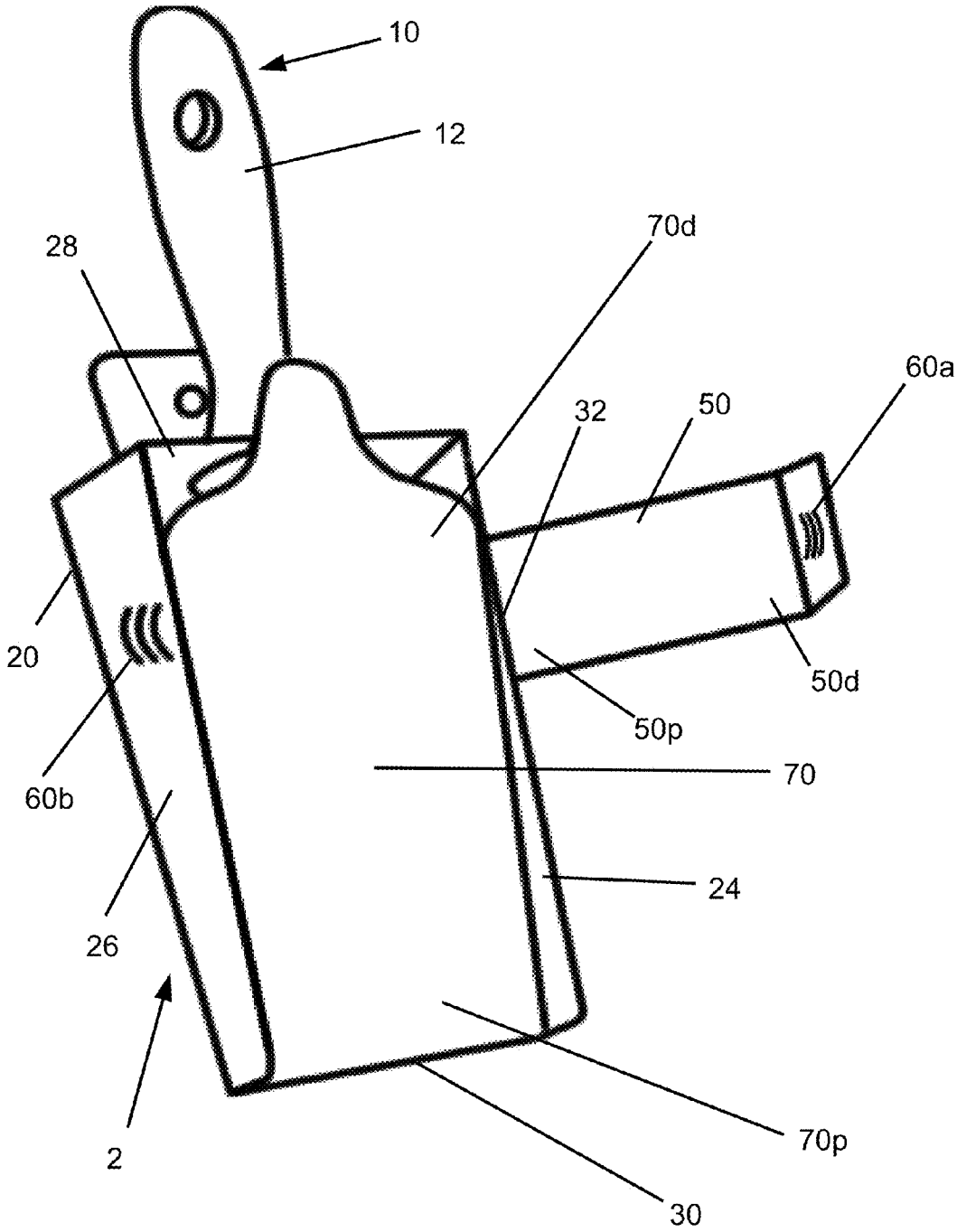
FIG. 4 shows a perspective view of a preferred embodiment of an apparatus according to the present disclosure with a paintbrush received into the apparatus and the bristle shaping flap positioned at its closed position and the second outer shell positioned at its open position.

Continuing with the embodiment shown in FIG. 2, first flexible coupling 30 couples first outer shell 20 to bristle shaping flap 70 so as to allow movement between an open position of the bristle shaping flap, which is shown in FIG. 2, and a closed position of the bristle shaping flap which is shown in FIG. 4. The open position of the bristle shaping flap allows a brush to be received into first outer shell 20. In the closed position the bristle shaping flap urges bristles 16 of brush 10 received therein into a natural shape that may be generally wedge or triangular in shape. Urging bristles into natural shapes promotes and preserves the quality and long life of the bristles. Bristle shaping flap 70 is sized so that when the flap is in the closed position at least a portion of bristle shaping flap 70 fits between first lateral panel 24 and second lateral panel 26. Bristle shaping flap 70 may be constructed of rigid or preferably semi rigid materials, wherein preferable materials are resistant to paints and the solvents typically found in paints. Bristle shaping flap 70 is shown having a proximal end 70*p* which is near first flexible coupling 30, and a distal end 70*d* which is away from said first flexible coupling. Bristle shaping flap 70 and the attached first flexible coupling 30 allow the apparatus to secure and accommodate brushes of different thicknesses.

Figure 5:
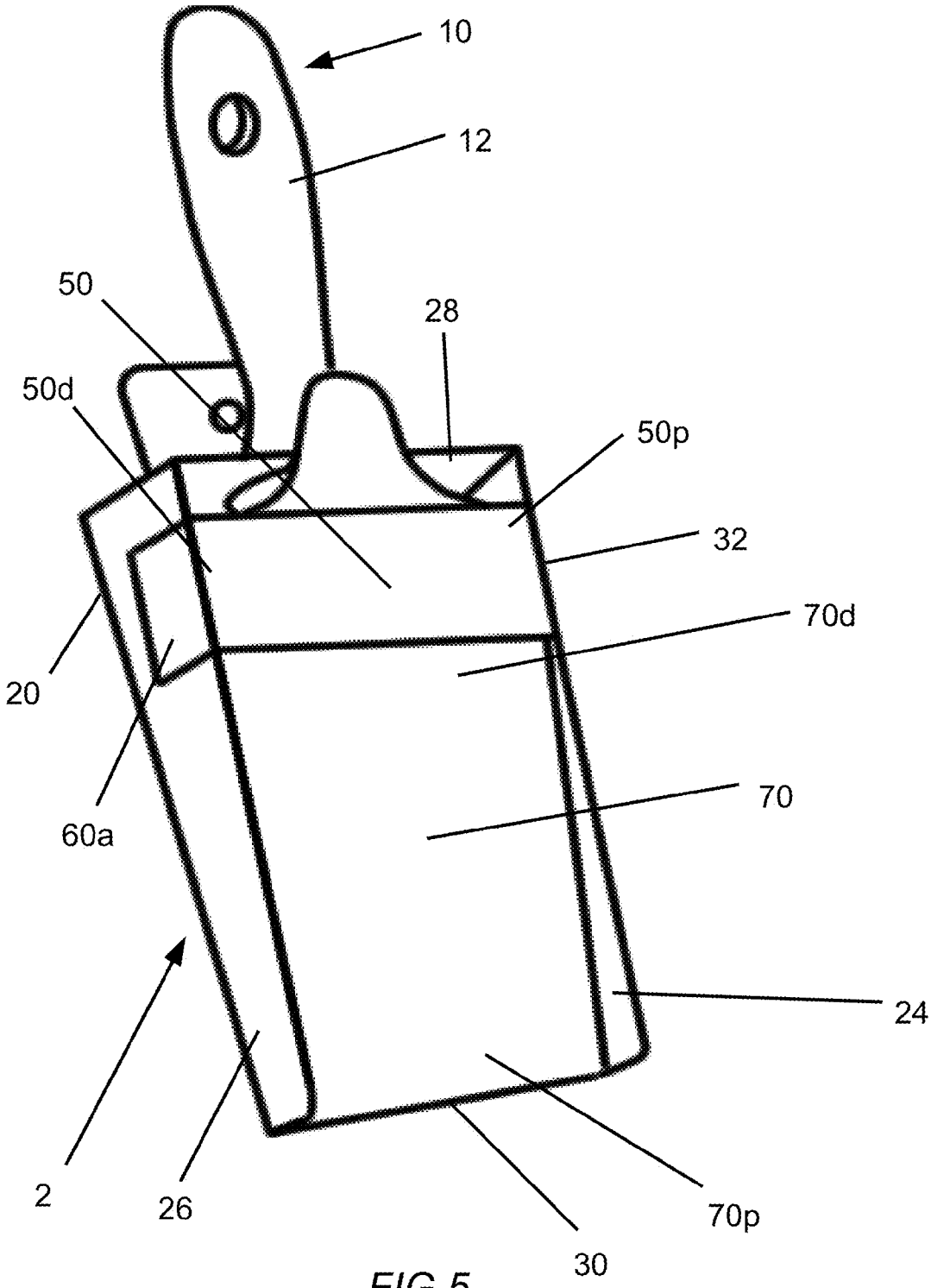
FIG. 5 shows a perspective view of a preferred embodiment of an apparatus according to the present disclosure with a paintbrush received into the apparatus and the bristle shaping flap positioned at its closed position and the second outer shell positioned at its closed position.

Also shown in FIG. 2 is second outer shell 50, which is coupled to first outer shell 20 by means of second flexible coupling 32. Second flexible coupling 32 couples first outer shell 20 to second outer shell 50 so as to allow movement between an open position of the second outer shell, which is shown in FIG. 2, and a closed position of the second outer shell, which is shown in FIG. 5. The open position of second outer shell 50 allows brush shaping flap 70 to be freely moved between its open and closed positions. In the closed position of second outer shell 50 the second outer shell urges brush shaping flap 70 to its closed position. Second outer shell is shown having a proximal end 50*p* which is near second flexible coupling 32, and distal end 50*d* which is away from second flexible coupling 32. Second outer shell 50 may be constructed of rigid or preferably semi rigid materials, wherein preferable materials are resistant to paints and the solvents typically found in paints.

Continuing with the embodiment shown in FIG. 2, a first fastener portion 60*a* is shown coupled to second outer shell 50 in proximity to second outer shell distal end 50*d*. A second fastener portion 60*b* is shown coupled to first outer shell 20 and positioned so that when second outer shell 50 is in its closed position first fastener portion 60*a* and second fastener portion 60*b* are disposed to fasten together. In a preferred embodiment first fastener portion 60*a* may be formed integral to second outer shell 50 and second fastener portion 60*b* may be formed integral to first outer shell 20 respectively.

FIG. 2 also shows an attachment means 82 that may be coupled to first outer shell 20 and works to facilitate attachment to a person's belt or other equivalent structures so as to permit the apparatus to be carried around by a person hands free and within easy reach.

Figure 3:
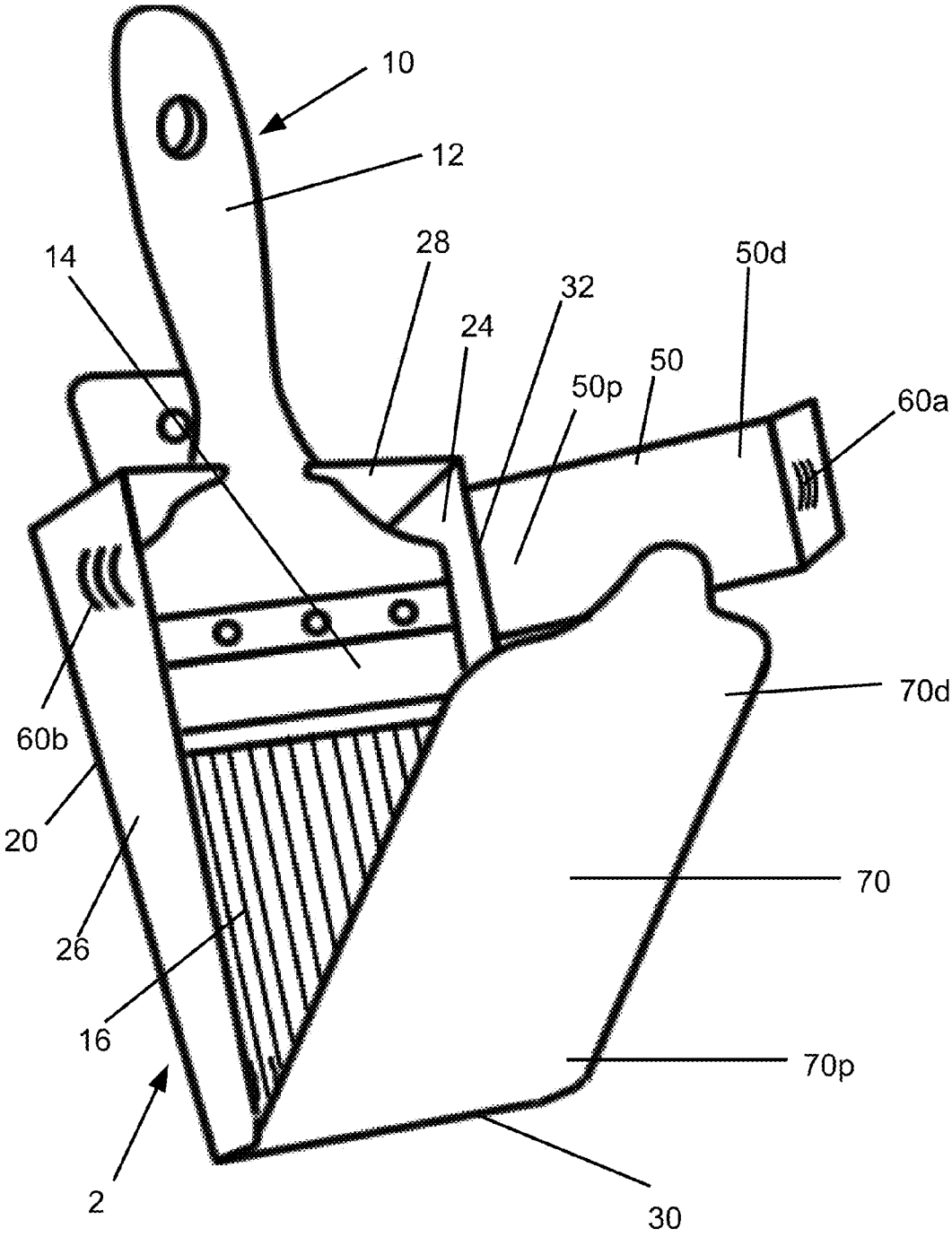
FIG. 3 shows a perspective view of a preferred embodiment of an apparatus according to the present disclosure with a paintbrush received into the apparatus and the bristle shaping flap positioned between its open and closed positions.

Turning now to FIG. 3, shown is a perspective view of a preferred embodiment of an apparatus according to the present disclosure wherein paintbrush 10 has been received into first outer shell 20 of magnetic brush protector and storage apparatus 2 and bristle shaping flap 70 is positioned between its open and closed positions. First magnet means 40 exerts an attractive force on ferrule 14 thereby urging brush 10 to stay within first outer shell 20.

Turning now to FIG. 4, shown is a perspective view of the same preferred embodiment as that shown in FIG. 3, wherein FIG. 4 shows an apparatus according to the present disclosure wherein paintbrush 10 has been received into first outer shell 20 of magnetic brush protector and storage apparatus 2 and bristle shaping flap 70 is positioned at its closed position and second outer shell 50 is positioned in its open position. Bristle shaping flap 70 is sized so that at least a portion of bristle shaping flap 70 fits between first and second lateral panels. FIG. 4 also shows that when bristle shaping flap 70 is in a closed position, bristle shaping flap proximal end 70*p* is positioned to urge bristles 16 together in a wedge shaped natural form.

Continuing with FIG. 4, also shown is bristle shaping flap distal end 70*d* in which a portion of the flap extends above top panel 28 when bristle shaping flap 70 is in its closed position. The portion extending above top panel 28 may be easily engaged by a person's thumb to move the bristle shaping flap through its range of motion.

Turning now to FIG. 5, shown is a perspective view of the same preferred embodiment as that shown in FIG. 3, wherein FIG. 5 shows an apparatus according to the present disclosure wherein paintbrush 10 has been received into first outer shell 20 of magnetic brush protector and storage apparatus 2 and bristle shaping flap 70 is positioned at its closed position and second outer shell 50 is positioned in its closed position. As indicated by FIG. 5, when second outer shell 50 is positioned in its closed position first fastener portion 60*a* may engage with second fastener portion 60*b* to secure paintbrush 10 into the apparatus.

Figure 6:
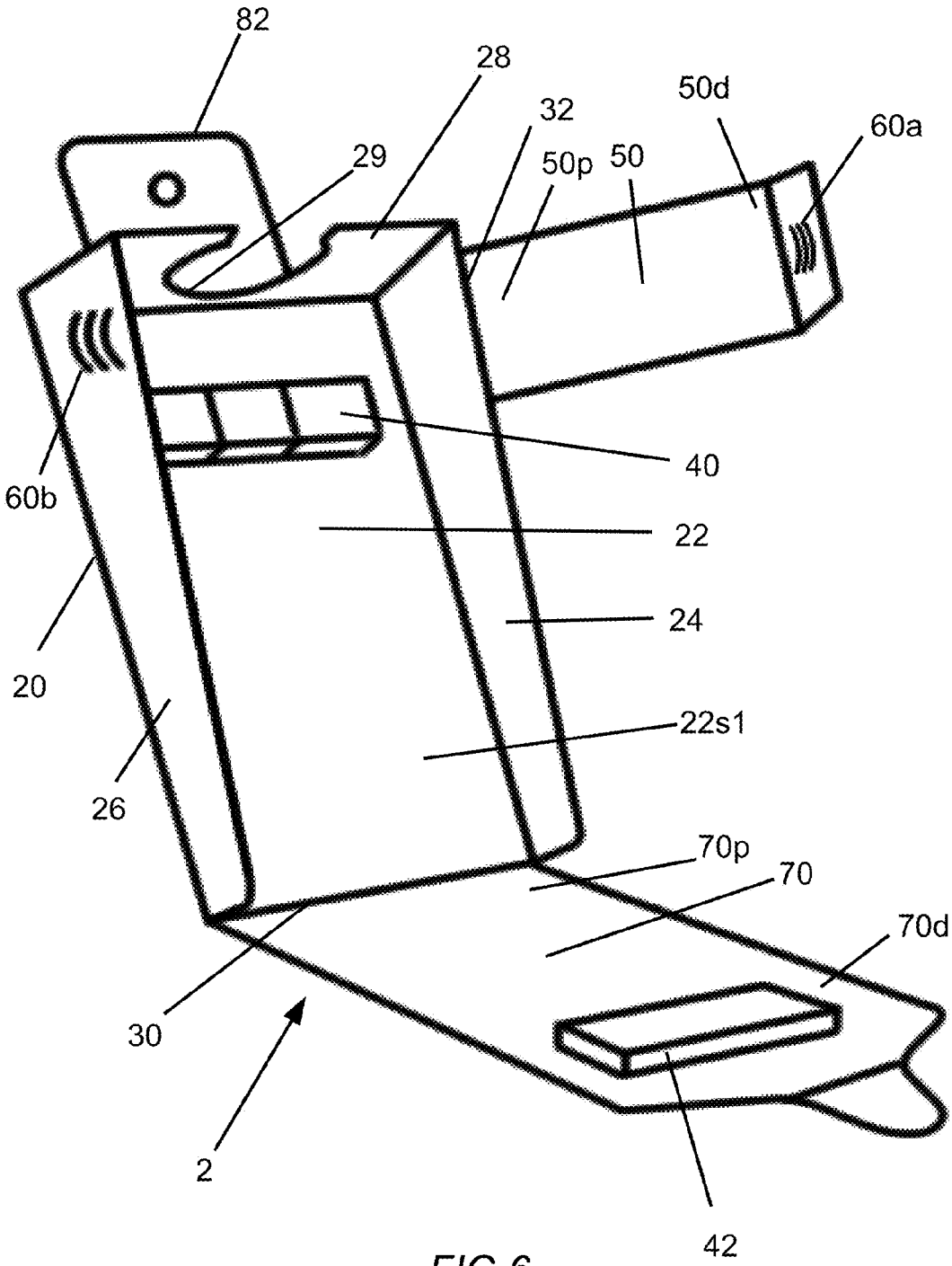
FIG. 6 shows a perspective view of another embodiment of an apparatus according to the present disclosure in which a second magnet means is used.

Turning now to FIG. 6, shown is a perspective view of another embodiment of an apparatus according to the present disclosure in which a second magnet means 42 is used. Second magnet means 42 is coupled to bristle shaping flap 70 and is positioned such that when bristle shaping flap 70 is in its closed position second magnet means 42 is attracted to magnet means 40. When brush 10 has been received into first outer shell 20 of the apparatus and bristle shaping flap 70 is in its closed position second magnet means may be attracted to ferrule 14 and thereby promote greater security in holding the brush in the apparatus. A preferred embodiment of second magnet means 42 is an elongate planar magnetic strip coupled to bristle shaping flap 70 such that the long axis of the elongate planar magnetic strip is disposed to be substantially parallel to top panel 28 and wherein second magnet means 42 is positioned to engage at least a portion of ferrule 14 when brush 10 has been received within first outer shell 20.

Figure 7:
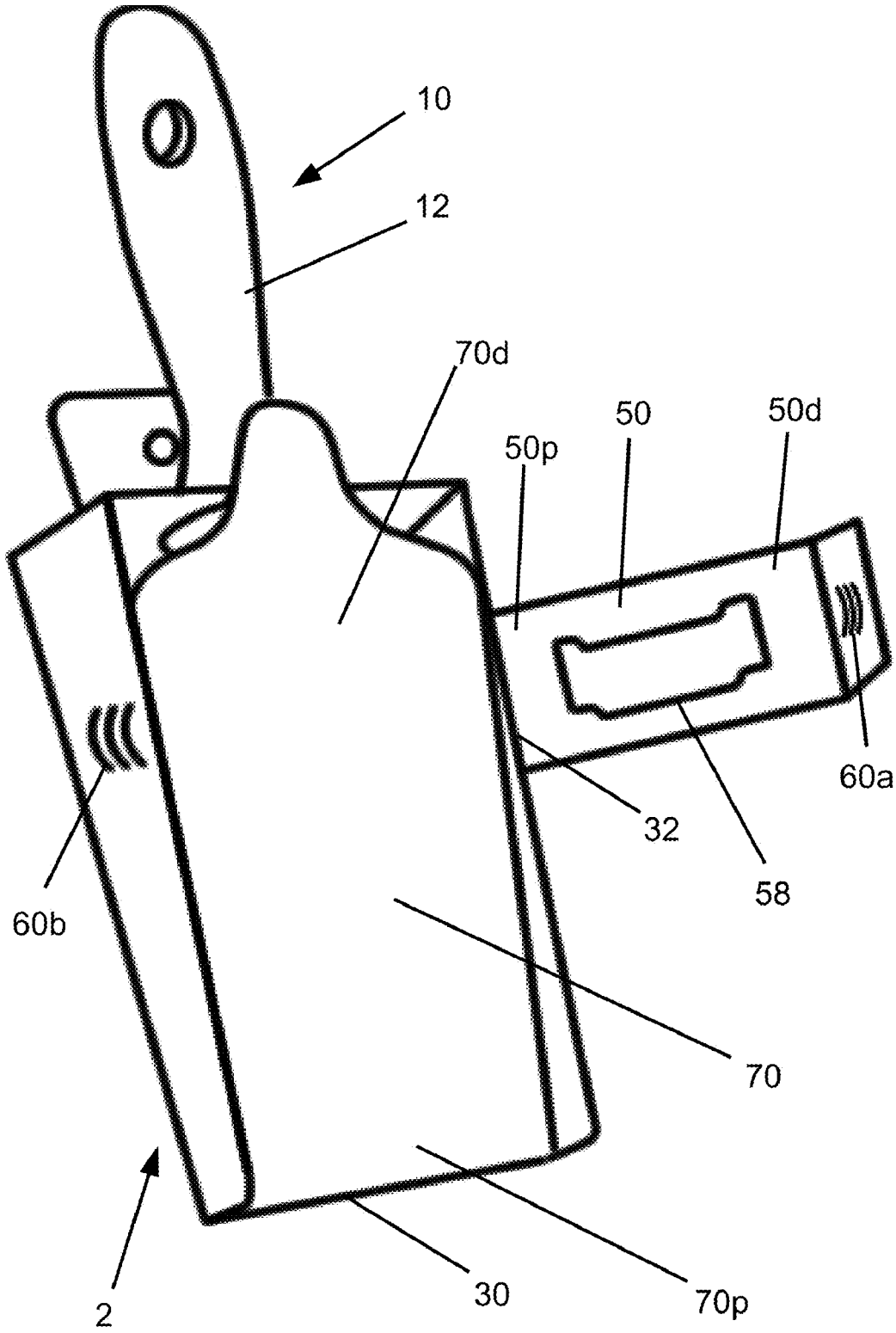
FIG. 7 shows a perspective view of another embodiment of an apparatus according to the present disclosure in which a spring means is attached to the second outer shell and works to urge the bristle shaping flap to its closed position.

Turning now to FIG. 7, shown is a perspective view of another embodiment of an apparatus according to the present disclosure in which a spring means 58 is coupled to second outer shell 50. As indicated in FIG. 7, when second outer shell 50 is in its closed position and first fastener portion 60*a* is fastened to second fastener portion 60*b* spring means 58 provides a spring force for urging bristle shaping flap 70 to its closed position. Spring means 58 provides a way to make sure that bristle shaping flap 70 remains snug against brush 10.

Figure 8:
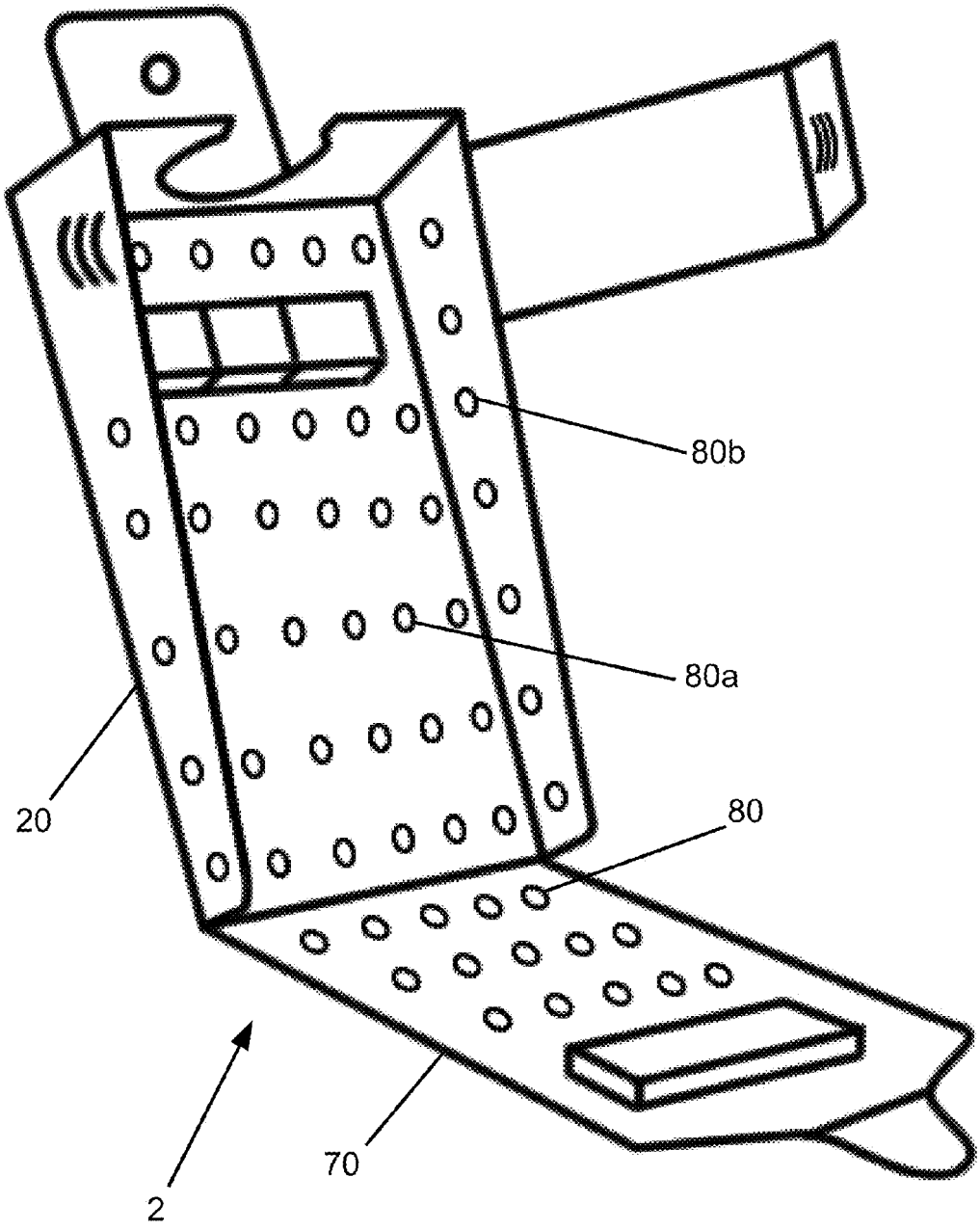
FIG. 8 shows a perspective view of another embodiment of an apparatus according to the present disclosure in which ventilation holes are present in both first outer shell and bristle shaping flap.

Turning now to FIG. 8, shown is a perspective view of another embodiment of an apparatus according to the present disclosure in which ventilation holes 80, 80*a*, and 80*b* are present in both first outer shell 20 and bristle shaping flap 70. After a brush has been cleaned it may be beneficial to allow the bristles to dry. For this purpose ventilation holes 80 may be included in any combination of the following elements according to this disclosure: first outer shell 20, second outer shell 50, and bristle shaping flap 70. Allowing bristles to dry while a brush is secured in the apparatus gives the added benefit of drying the bristles while shaping the bristles which results in well formed bristles ready for the next time the brush is used.

Figure 9A:
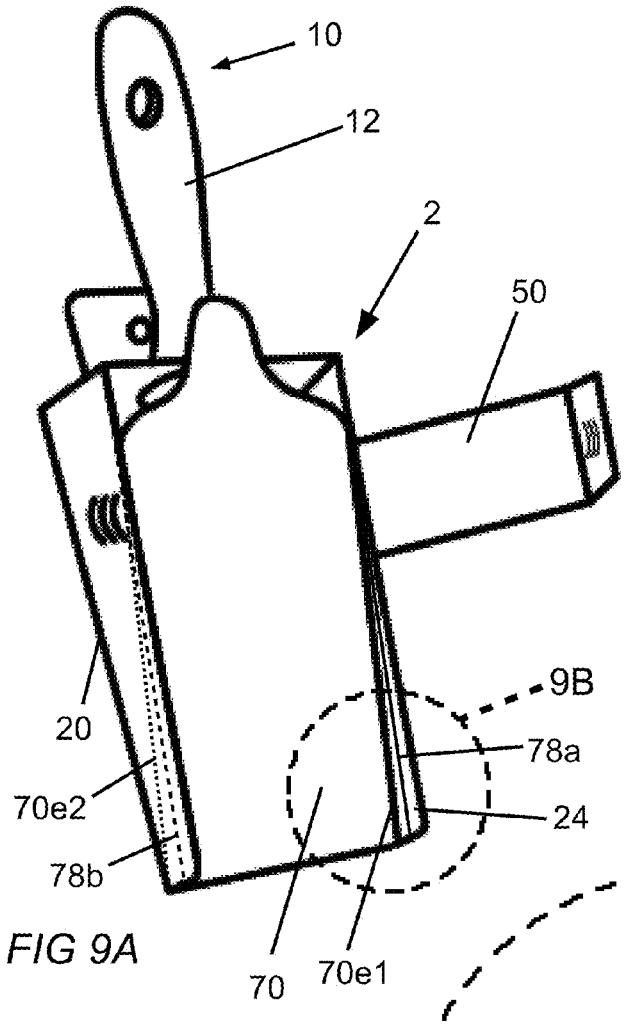
FIG. 9A shows a perspective view of another embodiment of an apparatus according to the present disclosure in which bristle retention skirts are used to movably seal the bristle shaping flap against lateral panels of the first outer shell.
Figure 9B:
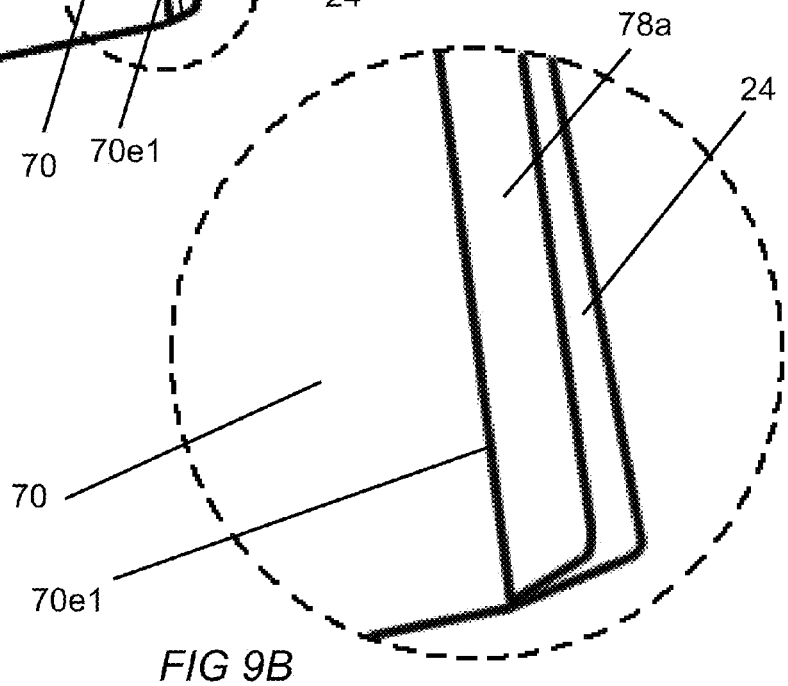
FIG. 9B shows an enlarged view of a portion of FIG. 9*a* in which bristle retention skirt is shown sealingly engaged with a lateral panel of the first outer shell.

Turning now to FIG. 9A, shown is a perspective view of another embodiment of an apparatus according to the present disclosure in which a first bristle retention skirt 78*a* and a second bristle retention skirt 78*b* are used to movably seal a portion of the bristle shaping flap 70 against first lateral panel 24 and second lateral panel 26 when bristle shaping flap 70 is in its closed position. First bristle retention skirt 78*a* is coupled to and coextensive with a portion of bristle shaping flap first edge 70*e*1 while second bristle retention skirt 78*b* is coupled to and coextensive with a portion of bristle shaping flap second edge 70*e*2. Bristle retention skirts 78*a* and 78*b* may be constructed of a flexible material so as to facilitate a compliant wiping action along a portion of first and second lateral panels when bristle shaping flap 70 is moved from an open position to a closed position. The bristle retention skirts 78*a* and 78*b* may be useful in preventing bristles from becoming trapped between bristle shaping flap edges 70*e*1, 70*e*2 and lateral panels 24, 26 respectively. FIG. 9B shows an expanded view of a portion of FIG. 9A in which portions of brush shaping flap 70, first bristle shaping flap edge 70*e*1, first bristle retention skirt 78*a*, and first lateral panel 24 are visible.

Figure 10:
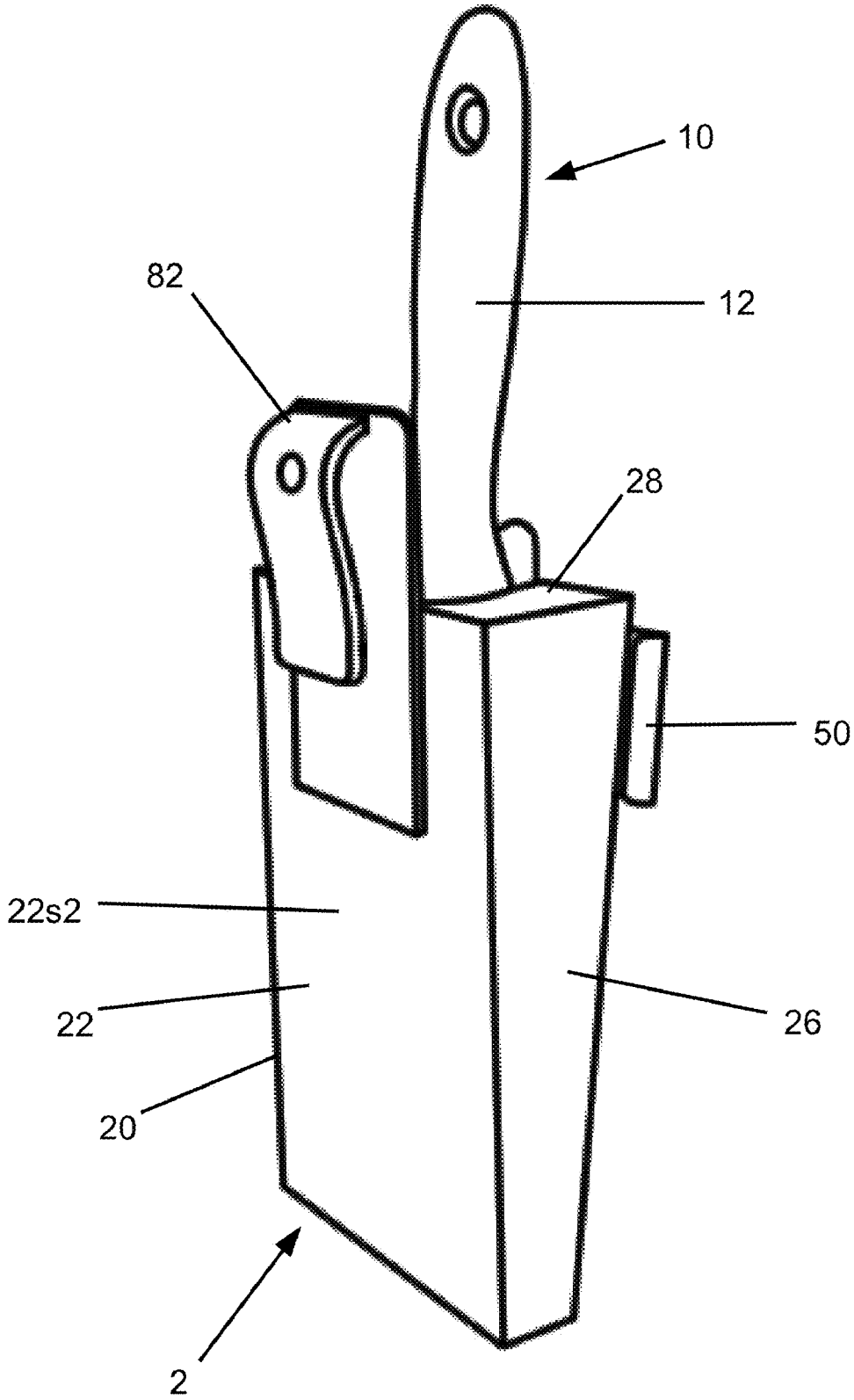
FIG. 10 shows a perspective view of the back of another embodiment of an apparatus according to the present disclosure in which an attachment means is coupled to the second side of the first outer shell.

Turning now to FIG. 10, shown is a perspective view of the back of an embodiment of an apparatus according to the present disclosure in which an attachment means 82 is coupled to back panel second side 22*s*2 of first outer shell 20. Attachment means 82 allows attachment of magnetic brush protector and storage apparatus 2 to other objects including but not limited to a pants pocket or a clothing belt. When the apparatus is attached at a persons waist, a portion of first lateral panel 24 will be substantially parallel to a portion of the person's leg while standing. This positioning facilitates quick access to the brush and allows easy one handed operation in storage and removal of the brush. Attachment means 82 may be formed out of the same materials as were used in forming first outer shell 20, and moreover, attachment means 82 may be formed integrally with first outer shell 20.

While the foregoing descriptions are intended to convey the structure and function of the elements comprising preferred embodiments of the invention, the disclosure now turns to the manner and method of using various embodiments of the invention.

In order to remove an already stored paintbrush from magnetic brush protector and storage apparatus 2 a person would first unfasten second outer shell 50 from its closed position and move said second outer shell to an open position. Next, the bristle shaping flap 70 may be moved from its closed position to an open position. Next, the brush 10 may be removed from the apparatus by grasping handle 12 and manipulating the brush until it is free of the apparatus. The bristle shaping flap may be moved back to its closed position after which the second outer shell may be moved back to its closed position. All of the actions needed to remove the brush from the apparatus may be performed using just one hand. One handed operation of the apparatus is particularly easy when the embodiment of the apparatus includes an attachment means and the apparatus is attached to a person's belt or pants pocket.

In order to store a paintbrush in a empty magnetic brush protector and storage apparatus 2 a person would first unfasten second outer shell 50 from its closed position and move said second outer shell to an open position. Next, the bristle shaping flap 70 may be moved from its closed position to an open position. Next, the brush may be placed in first outer shell 20 with brush handle 12 located in top panel recess portion 29 and with first magnet means 40 engaging ferrule 14 so that ferrule 14 and bristles 16 are contained between first lateral panel 24 and second lateral panel 26. Next, bristle shaping flap 70 may be moved from an open position to a closed position. Next, second outer shell may be moved from an open position to a closed position in which first fastener portion 60*a* is fastened to second fastener portion 60*b* at which time the brush will be safe and secure in the apparatus. All of the actions needed to store the brush in the apparatus may be performed using just one hand. One handed operation of the apparatus is particularly easy when the embodiment of the apparatus includes an attachment means and the apparatus is attached to a person's belt or pants pocket.

Although the present invention has been described in considerable detail with reference to certain preferred versions thereof, other versions are possible. Therefor, the spirit and scope of the appended claims should not be limited to the description of the preferred versions contained herein.

Any element in a claim that does not explicitly state "means for" performing a specified function, or "step for"

performing a specific function, is not to be interpreted as a "means" or "step" clause as specified in 35 U.S.C. Section 112, Paragraph 6. In particular, the use of "step of" in the claims herein is not intended to invoke the provisions of 35 U.S.C. Section 112, Paragraph 6.

What is claimed is:

1. An apparatus for storing and protecting a paint brush comprising:

a) a first outer shell comprising: a back panel having a first side and a second side; a first lateral panel coupled to said first side of said back panel; a second lateral panel coupled to said first side of said back panel, wherein a portion of said first lateral panel and a portion of said second lateral panel are substantially parallel; a top panel coupled to said first side of said back panel and coupled to said first lateral panel and coupled to said second lateral panel, wherein said top panel has a recess portion, and wherein said top panel is substantially perpendicular to at least a portion of said first lateral panel;

b) a first magnet means coupled to said back panel of said first outer shell wherein said first magnet means is substantially parallel to said top panel of said first outer shell;

c) a bristle shaping flap having a proximal end and a distal end, wherein at least a portion of said bristle shaping flap is sized to movably fit between said first lateral panel and said second lateral panel;

d) a first flexible coupling connecting said first outer shell to said proximal end of said bristle shaping flap, wherein said first flexible coupling allows movement of said bristle shaping flap with respect to said first outer shell to a closed position in which at least a portion of said bristle shaping flap is disposed between at least a portion of said first lateral panel and at least a portion of said second lateral panel, and, wherein said first flexible coupling allows movement of said bristle shaping flap with respect to said first outer shell to an open position in which no portion of said bristle shaping flap is disposed between said first lateral panel and said second lateral panel;

e) a second outer shell having a first side, a second side, a proximal end, and a distal end;

f) a second flexible coupling connecting said first lateral panel of said first outer shell to said proximal end of said second outer shell, wherein said second flexible coupling allows movement of said first outer shell with respect to said second outer shell to a closed position in which said second outer shell urges said bristle shaping flap to its closed position, and, wherein said second flexible coupling allows movement of said first outer shell with respect to said second outer shell to an open position in which said second outer shell is disposed to allow said bristle shaping flap to move between its open and closed positions; and, g) a fastener comprising a first portion and a second portion, wherein said first portion of said fastener is coupled to said first outer shell and wherein said second portion of said fastener is coupled to said distal end of said second outer shell, and wherein said first portion and said second portion of said fastener are disposed to fasten to each other when said second flexible coupling is in said closed position.

2. The apparatus of claim 1 further comprising: a second magnet means coupled to said bristle shaping flap, wherein said second magnet means is located towards said distal end of said bristle shaping flap, and, wherein said second magnet means is positioned substantially parallel to said first magnet means when said bristle shaping flap is in said closed position.

3. The apparatus of claim 1 further comprising: spring means coupled to the second outer shell, wherein said bristle shaping flap is urged to its closed position by said spring means when the second outer shell is in its closed position.

4. The apparatus of claim 1 wherein at least one element from the group consisting of: first outer shell, second outer shell, and bristle shaping flap, has a plurality of ventilation holes.

5. The apparatus of claim 1 wherein the bristle shaping flap has a first edge and a second edge, the apparatus further comprising: a first bristle retention skirt coupled to said bristle shaping flap and coextensive with at least a portion of said first edge of said bristle shaping flap, and a second bristle retention skirt coupled to said bristle shaping flap and coextensive with at least a portion of said second edge of said bristle shaping flap, wherein said first bristle retention skirt is sized to movably fit against said first lateral panel when said bristle shaping flap is in its closed position, and, wherein said second bristle retention skirt is sized to movably fit against said second lateral panel when said bristle shaping flap is in its closed position.

6. The apparatus of claim 1 further comprising: an attachment means coupled to said second side of said back panel of said first outer shell, wherein said attachment means is positioned to align a portion of said first lateral panel substantially parallel with a portion of a leg of a person when the apparatus is attached to a belt worn by said person.

7. The apparatus of claim 1 wherein a portion of the bristle shaping flap extends above said top panel of said first outer shell when said bristle shaping flap is in its closed position.

8. The apparatus of claim 1 wherein first magnet means is an elongate planar magnetic strip.

9. The apparatus of claim 2 wherein second magnet means is an elongate planar magnetic strip.

10. A system for protecting and storing a paintbrush comprising:

a) a paintbrush comprising: a handle, a ferromagnetic ferrule, and bristles, wherein said handle is coupled to said ferrule, and wherein said bristles are coupled to said ferrule;

b) an apparatus for protecting and storing a paintbrush, said apparatus comprising:

i) a first outer shell comprising: a back panel having a first side and a second side; a first lateral panel coupled to said first side of said back panel; a second lateral panel coupled to said first side of said back panel, wherein a portion of said first lateral panel and a portion of said second lateral panel are substantially parallel; a top panel coupled to said first side of said back panel and coupled to said first lateral panel and coupled to said second lateral panel, wherein said top panel has a recess portion, and wherein said top panel is substantially perpendicular to at least a portion of said first lateral panel;

ii) a first magnet means coupled to said back panel of said first outer shell wherein said first magnet means is substantially parallel to said top panel of said first outer shell;

iii) a bristle shaping flap having a proximal end and a distal end, wherein at least a portion of said bristle shaping flap is sized to movably fit between said first lateral panel and said second lateral panel;

iv) a first flexible coupling connecting said first outer shell to said proximal end of said bristle shaping flap, wherein said first flexible coupling allows movement of said bristle shaping flap with respect to said first outer shell to a closed position in which at least a portion of said bristle shaping flap is disposed between at least a portion of said first lateral panel and at least a portion of said second lateral panel, and, wherein said first flexible coupling allows movement of said bristle shaping flap with respect to said first outer shell to an open position in which no portion of said bristle shaping flap is disposed between said first lateral panel and said second lateral panel;

v) a second outer shell having a first side, a second side, a proximal end, and a distal end;

vi) a second flexible coupling connecting said first lateral panel of said first outer shell to said proximal end of said second outer shell, wherein said second flexible coupling allows movement of said first outer shell with respect to said second outer shell to a closed position in which said second outer shell urges said bristle shaping flap to its closed position, and, wherein said second flexible coupling allows movement of said first outer shell with respect to said second outer shell to an open position in which said second outer shell is disposed to allow said bristle shaping flap to move between its open and closed positions; and, vii) a fastener comprising a first portion and a second portion, wherein said first portion of said fastener is coupled to said first outer shell and wherein said second portion of said fastener is coupled to said distal end of said second outer shell, and wherein said first portion and said second portion of said fastener are disposed to fasten to each other when said second flexible coupling is in said closed position.

11. The system of claim 10 wherein the apparatus further comprises: a second magnet means coupled to said bristle shaping flap, wherein said second magnet means is located towards said distal end of said bristle shaping flap, and, wherein said second magnet means is positioned substantially parallel to said first magnet means when said bristle shaping flap is in said closed position.

12. The system of claim 10 wherein the apparatus further comprises: spring means coupled to the second outer shell, wherein said bristle shaping flap is urged to its closed position by said spring means when the second outer shell is in its closed position.

13. The system of claim 10 wherein at least one element from the group consisting of: first outer shell, second outer shell, and bristle shaping flap, has a plurality of ventilation holes.

14. The system of claim 10 wherein the bristle shaping flap has a first edge and a second edge, the apparatus further comprising: a first bristle retention skirt coupled to said bristle shaping flap and coextensive with at least a portion of said first edge of said bristle shaping flap, and a second bristle retention skirt coupled to said bristle shaping flap and coextensive with at least a portion of said second edge of said bristle shaping flap, wherein said first bristle retention skirt is sized to movably fit against said first lateral panel when said bristle shaping flap is in its closed position, and, wherein said second bristle retention skirt is sized to movably fit against said second lateral panel when said bristle shaping flap is in its closed position.

15. The system of claim 10 wherein the apparatus further comprises: an attachment means coupled to said second side of said back panel of said first outer shell, wherein said attachment means is positioned to align a portion of said first lateral panel substantially parallel with a portion of a leg of a person when the apparatus is attached to a belt worn by said person.

16. The system of claim 10 wherein a portion of the bristle shaping flap extends above said top panel of said first outer shell when said bristle shaping flap is in its closed position.

17. The system of claim 10 wherein first magnet means is an elongate planar magnetic strip.

18. The system of claim 11 wherein second magnet means is an elongate planar magnetic strip.

* * * * *